US005181772A

United States Patent [19]

Albiez

[11] Patent Number: 5,181,772

[45] Date of Patent: Jan. 26, 1993

[54] FURNITURE ELEMENT

[75] Inventor: Alfred Albiez, Langen, Austria

[73] Assignee: Alfit Aktiengesellschaft, Gotzis, Austria

[21] Appl. No.: 728,257

[22] Filed: Jul. 11, 1991

[51] Int. Cl.[5] ..... A47B 47/00

[52] U.S. Cl. ..... 312/348.4; 312/348.2

[58] Field of Search ..... 312/348.1, 348.2, 348.4

[56] References Cited

U.S. PATENT DOCUMENTS 1,936,733 11/1933 Richardson .
4,099,815 7/1978 Cox et al. ..... 312/348.2

FOREIGN PATENT DOCUMENTS 0267477 5/1988 European Pat. Off. .
0323822 7/1989 European Pat. Off. .
2649787 5/1977 Fed. Rep. of Germany .
3713282 12/1987 Fed. Rep. of Germany .
3801103 8/1988 Fed. Rep. of Germany ... 312/348.4

*Primary Examiner*—Peter R. Brown
*Attorney, Agent, or Firm*—Collard & Roe

[57] ABSTRACT

In a furniture element, in particular a drawer, in which at least two long flat structural elements form a corner with their long ends and are secured to each other by connectors that form a push connection with at least one structural element, in order to simplify assembly and make it possible to use prefabricated structural elements, the structural element that is intended for the push connection as a profile element is provided with an insertion guide for a supporting element of the connector element formed from profile projections that are moulded onto at least one flat side and that run the length of the element, and that when this element is in the inserted position it can be fixed in the insertion guide so as to ensure a form or force fit.

15 Claims, 6 Drawing Sheets

1
8
18
9
5
14
30
24
29
26
28
24
II
II
3
24
6
7
31
27
24

FURNITURE ELEMENT

BACKGROUND OF THE INVENTION

1. Field of the Invention

The present invention relates, in general, to a furniture element, in particular a drawer, in which the long ends of each of two longitudinally extended, flat, structural elements form a corner, and are secured to each other by connectors that form a push connection with at least one of the structural elements.

A development of the present invention relates to a furniture element that is formed as a drawer with metal frames with the longitudinally extended structural elements, said frames incorporating supports for the bottom of the drawer and incorporating a drawer rail that forms part of a pull set for the drawer, this incorporating a hollow space that extends to the length of the frame and in which is installed a supporting and adjusting set for the front panel of the drawer that forms the connecting element, it being possible to operate the adjusting elements of this form outside the frame.

2. Prior Art

Not only drawers, but all elements in which long structural elements are to be connected at at least one corner are to be understood by furniture elements of the type described heretofore. As examples, one could mention frame or peg connectors, and the like. In so far as at least one of the two long structural elements that are to be joined are of a material that can be nailed or screwed without significant preparation, e.g., wood or chip-board panels, it is possible to use the most varied types of nail or claw connectors, as well as screws. According to U.S. Pat. No. 1,936,733, shaped sheet-metal parts are used as corner connectors for drawer walls that are of material that can be nailed; in these, angled retaining flanges engage in preformed grooves of one long structural element and can be inserted into a corner recess of the other structural element and then driven into the material of this latter structural element with claw pieces. It is not possible to automate the assembly of drawers of this kind.

The connectors that have been described, which are of plastic or metal, in particular aluminum, can no longer be used. In the case of furniture elements formed as drawers in accordance with the application described above, there is frequently a requirement that at least the front panel of the drawer be adjustable after installation. A drawer intended for a preferred application is described in EP-A-0 267 477. In this, the frames that are formed as one-piece extruded profiles form the drawer rails of the pull set with an upper profile section; beneath these, a rectangular cross section tube profile is formed from the frame, and a guide housing of the adjuster set is slid into this from the front. This can then be secured by screws that pass through the walls of the hollow profile. There are openings in the outer side of the tube profile so as to permit operation of the adjusting elements of the adjusting set. It is preferred that there be supports on the front panel that can be suspended in an adjuster of the adjuster set. The complete system entails considerable manufacturing and assembly costs.

According to DE-A-37 13 282, there is a continuous depression in the outer wall of the tube profile, at the level of the installation area for the operating openings for the adjuster elements of the adjuster set. This can be closed off by a plastic trim strip.

EP-A-0 323 822 describes a draw with an adjuster set that is secured to the outside of a frame by means of a supporting plate. By making use of eccentric adjusters and setting screws, and by using a similarly adjustable intermediate plate, this makes it possible to adjust the position of the front panel of the drawer precisely up and down, forward and backward, and to the sides, as well as its slope, although the operating elements for the adjuster set must be accessible only from outside the frame.

In the case of drawers that are made from sheet metal, it is known that the back wall of the drawer can be secured to the frame by folds that are made subsequently; this increases the amount of assembly work that has to be done. Finally, it is also known that all the essential parts of a drawer, with the exception of the fittings and adjuster sets for the front panel, is fitted, can be extruded from plastic, in which connection it is possible to either provide an inner tub or box to which the side walls, the front panel, and the drawer back can be secured, or, as described in DE-OS 26 49 787, to injection-mould a drawer bottom panel and all the side walls as moulded plastic parts that incorporate catches and notches that are moulded in or onto the parts so as to produce unreleasable snap connections with abutting side walls and the drawer bottom. When this is done, special moulds are needed for each size of bottom and walls, so that the production of such a drawer only appears reasonable if done at normal mass-production scales.

SUMMARY OF THE INVENTION

It is the task of the present invention to create a furniture element in which, by using simple means, it is possible to produce a connection of long or flat structural elements from material that does not permit the use of nails or screws, or does so to only a limited extent, in which the long components can be cut off from stock extrusion and assembly effected in a largely automated system. A further task of the present invention is to simplify the overall production process for a drawer of the preferred type, and installation of the adjuster set for the front panel and adjustment itself, and to make it possible to use identical elements for drawers of different appearance and of different sizes.

This task has been solved in that the structural elements intended for the push connection as a profile element is provided with an insertion guide for a supporting element of the connector element formed from profile projections that are moulded onto at least one flat side and that run the length of the element, and that when this element is in the inserted position it can be fixed in the insertion guide so as to ensure a form or force fit.

The structural elements intended for the push connection can be cut off to the required length from extruded stock, so that the identical starting materials and identical connecting elements can be used for the most varied furniture elements and for the the most varied sizes. The push connections are made by insertion and form or force fitting the connecting element in the insertion guide, which means that the overall assembly process is extremely simple.

According to a preferred embodiment, the profile projections of the insertion guide are separated equidistantly from each other in diametrically opposed pairs, and establish grooves that are open to each other. The free positioning of the profile projections makes it possible to make cuts in them and/or, if the profiles are manufactured from suitable material, e.g., deformable metal, to hold them by form fit by deforming the supporting element that is introduced. It is then advantageous if the profile projections are of an angle profile.

According to a preferred embodiment, the supporting element is formed as a panel, the long edges of which can be slid into the grooves of the profile projections.

According to an advantageous development, in the insertion guide there are detent or snap projections or recesses for catches that are formed from the supporting element, so that the supporting element can be secured in the insertion guide by the formation of a snap-in connection. A particularly simple and secure configuration of this basic construction provides for the fact that the supporting element incorporates two supporting arms that spring apart, the unattached ends of which can be inserted into the insertion guide; at the unattached ends, these supporting arms have the catches by which they engage in the notches when in the inserted position. In this embodiment, the connection is formed by simply inserting the supporting arms. The catches can be formed by recesses in the profile, in the base area of the groove of the profile projections.

In order to arrive at a connection that, to a large extent, will not be loosened by blows, vibration, and other stresses when the particular furniture element is used, and at the same time is simple to produce and can be released when desired, one development provides for the fact that on the supporting arms there is a spreader that bridges the gap between the supporting arms and can be slid longitudinally from a rest position that permits the insertion of the supporting arms into the slide guide into a spread position that locks the catches in the detent position. It is an advantage that the connecting element can be in the form of a moulded plastic part, although it can also be of metal. In order to simplify assembly, the spreader is best attached to the connecting element so that it cannot be lost. In order to arrive at a simple construction, the spreader is guided on the sides of the supporting arms that face each other on guide channels, and when the supporting arms themselves are in the latched position they are secured in detent notches in these sides of the supporting arms, so that it is only possible to release the connection after disengaging the spreader from the detent notches in the supporting arms and thus only when it is desired to disassemble the unit.

As has already been discussed, the long structural elements can be the side walls, and the front or back or a drawer.

In order to solve this secondary taks in the case of a drawer according to a preferred embodiment, provision is made such that the frame consists of two profile elements that are releaseably connected to each other, of which one is fitted with the drawer rail of the pull set and has a grooved profile that is open to the outer side, and the second is configured as the cover that closes off the groove opening so as to form a hollow profile, said cover being slid or set into position; and such that the profile element that has the drawer rail is provided with the supports for the drawer bottom and within the groove opening, with the insertion guides formed by the profile projections and cross pieces for a supporting element for the adjusting set that is configured as a supporting plate.

In this case, the adjuster set with its supporting plate (in certain cases with supporting arms that spring apart) is secured to the insertion guides, without any outwardly projecting securing elements or assembly openings being necessary, such that adjustments can be made to the adjuster set very easily when the cover profile has been removed. When a flange of a retaining piece that is secured to the front wall of the drawer is used, the cover can be cut out in the area of this flange, or can extend only far enough that the necessary adjustment play is maintained at the flange and at the front panel. Depending on the drawer type, the cover profiles can be differently shaped for identical profile elements and can be provided with different surface coatings or profile shapes, or can be of different colours or surface patterns, or bear lettering.

According to another configuration, provision is made for the fact that the two profile elements are of material of lesser strength, in particular aluminum, and the drawer rails of the pull set are of a greater strength material, such as steel, the drawer rail being secured by claws that are pressed through openings in the associated profile elements. In such a case, during manufacture, the profile elements that are of aluminum can have various surface properties imparted to them by anodizing, coating, lacquering, and the like. Attachment of the drawer rails by claws that are pressed into position makes it easier to automate final assembly, when, as the claws are being pressed into position, a permanent deformation of the insertion guide can be brought about in order to fix the supporting plate into position if one prefers not to secure the supporting plate by the above-described snap connection.

Another development provides for the fact that the drawer rail of the pull set, which is attached at about the level of the drawer bottom in the area of the lower edge of the associated profile element, incorporates a moulded-in flange that reinforces the profile element in the contact area of the support for the drawer bottom.

It is also possible to form both the frame as well as at least the back of the drawer, and optionally the drawer front, from extruded profiles and then connect these to each other by connectors of the type described heretofore, when preferably the drawer bottom is held in insertion grooves or other retaining profiles and frames. It is also possible to use an embodiment, according to which the drawer bottom extends below the drawer back so that this forms a hold-down for the drawer bottom when in the assembled position. Both the frames and the front or back walls of the drawer can be provided with hold-downs that overlap the bottom of the drawer, e.g., which include hollow wedges with the associated profile, which provides for dust-tight closure of the space within the draw without the need to provide dust strips.

In another development, the connecting element is formed as a corner connector for the frames and front or rear walls of the drawer, this incorporating a supporting body that matches the cross section shape of the frame or front or back wall that extends as far as it and which fills the re-entrant corner that is formed between these, and from which the supporting elements that can be inserted into the insertion guide extend. It is advantageous if the connecting element be formed as an injection-moulded part.

BRIEF DESCRIPTION OF THE DRAWINGS

Additional details and advantages of the present invention are contained in the explanation of the drawings which follows.

The invention will be described in greater detail below on the basis of embodiments shown in the drawings appended hereto. These drawings show the following.

DETAILED DESCRIPTION OF THE PREFERRED EMBODIMENTS

Figure 1:
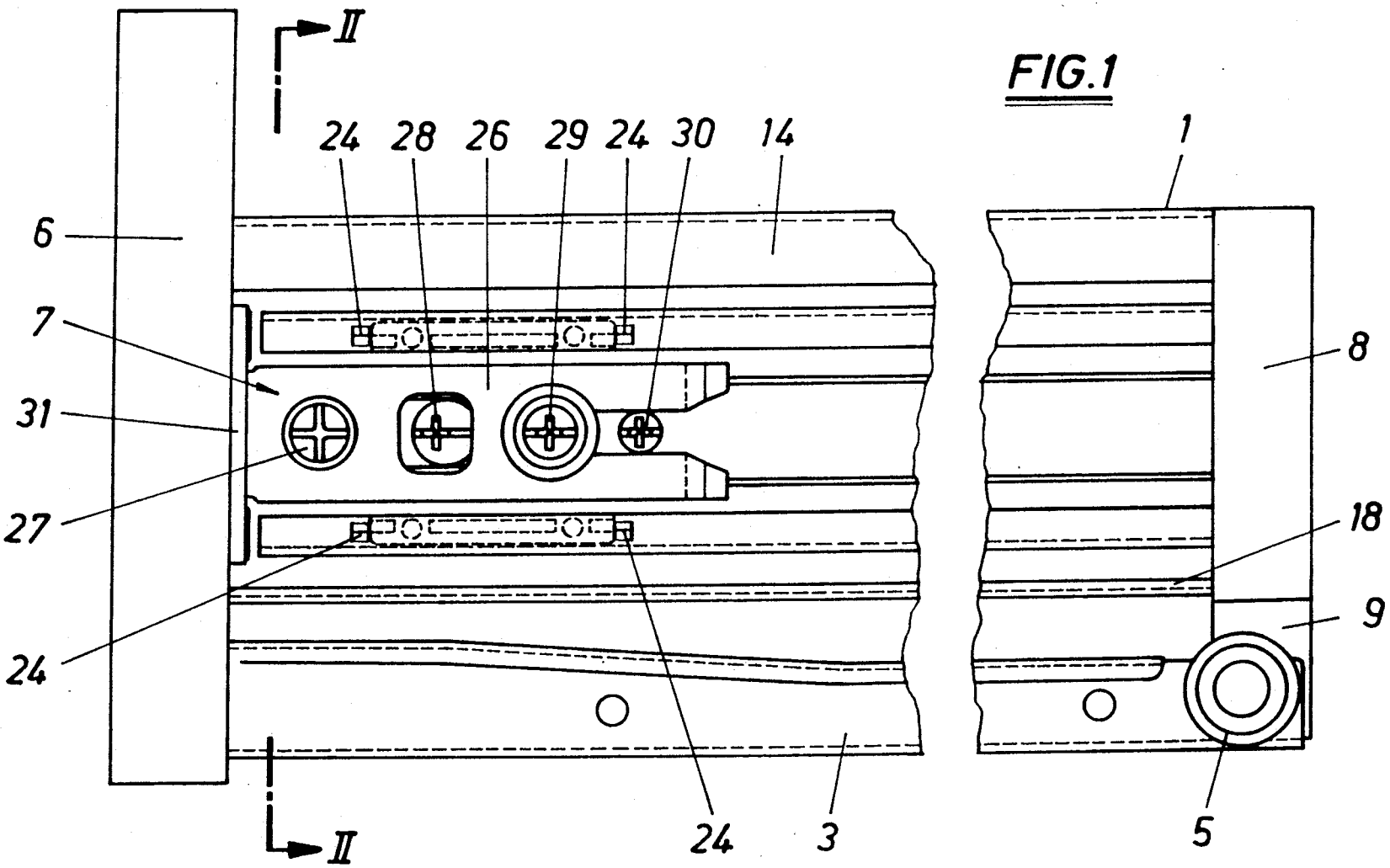
FIG. 1: A side view of a drawer according to the present invention, with the cover profile removed and the front panel and rear wall being indicated only, and in which only the drawer rail of the pull set is shown.
Figure 2:
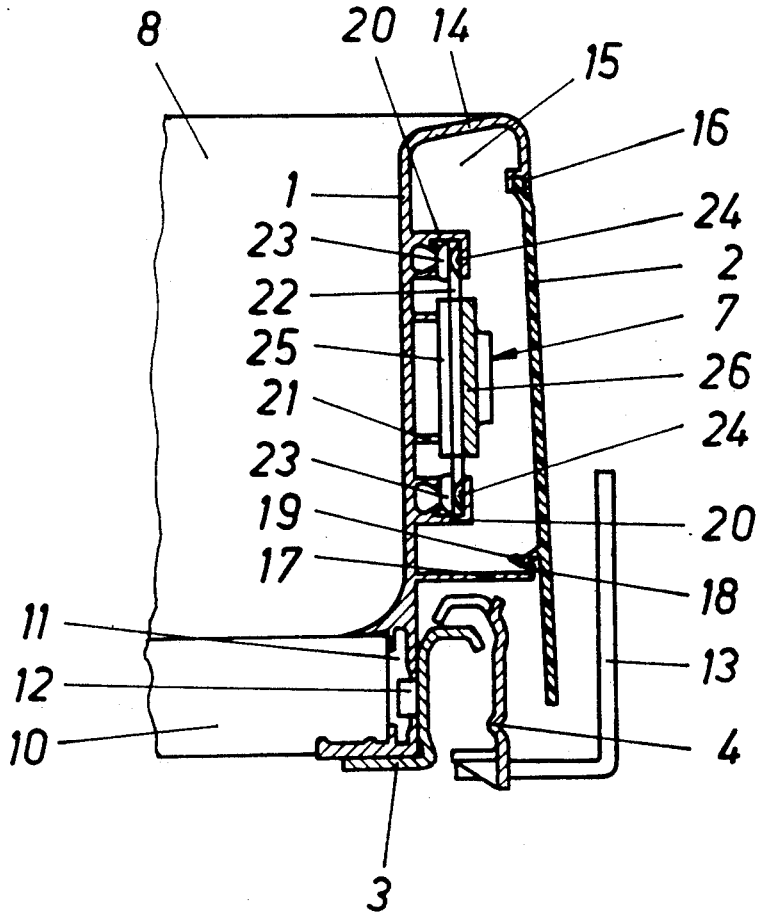
FIG. 2: A cross section through the frame and pull set on the line II—II in FIG. 1, with the guide rollers omitted.
Figure 3:
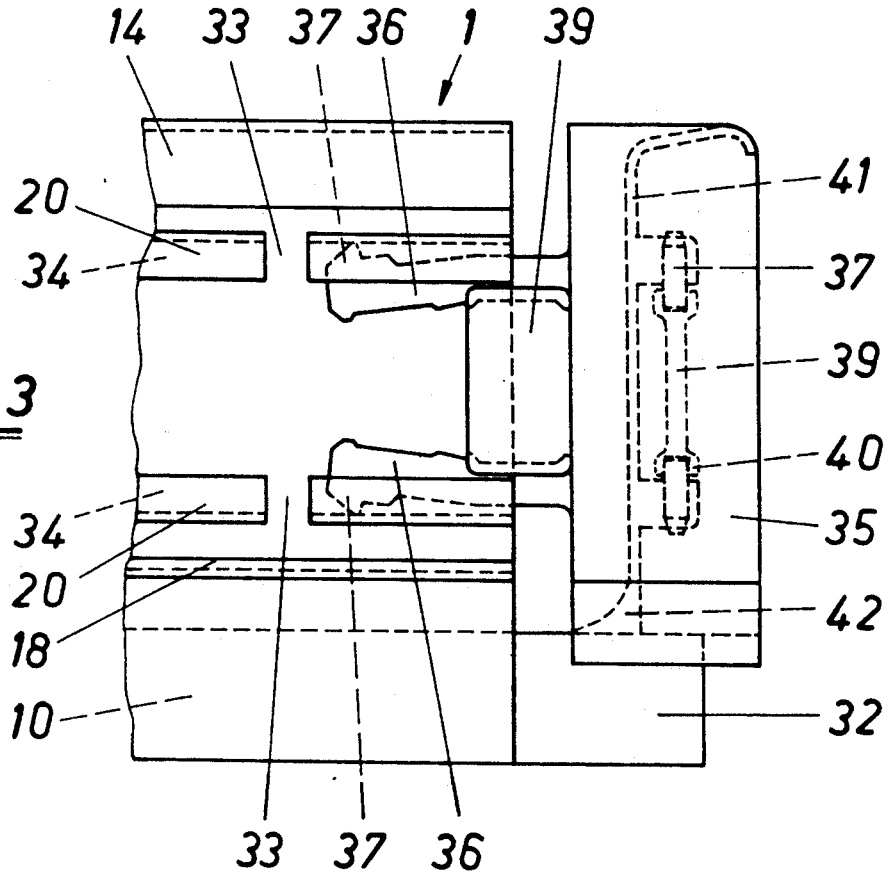
FIG. 3: The rear end of a drawer, with the pull set omitted, with the rear wall installed but not yet secured.
Figure 4:
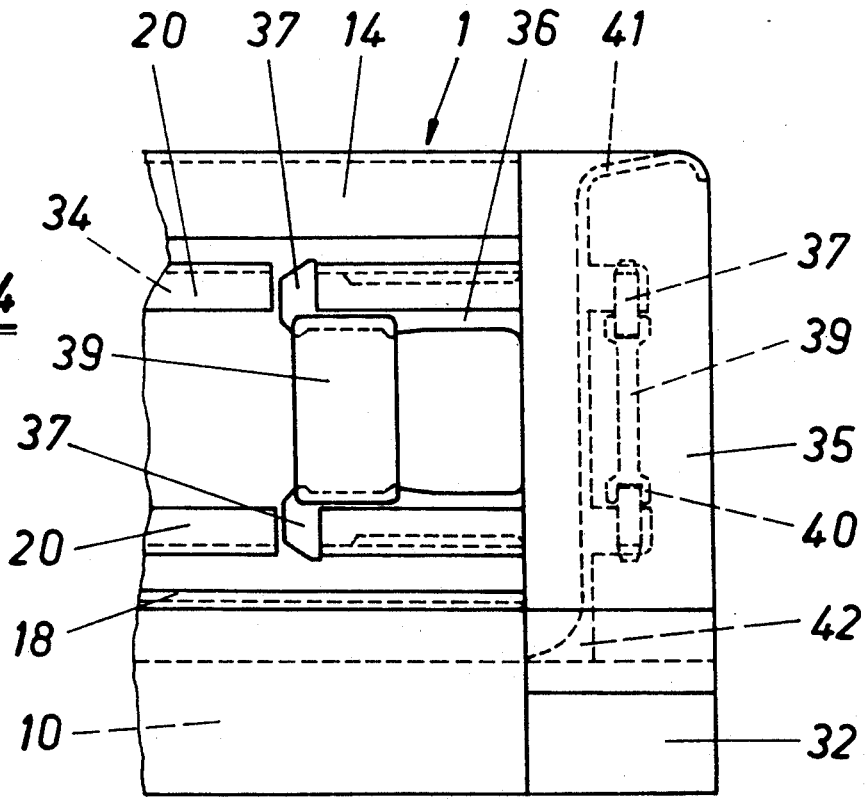
FIG. 4: A view corresponding to the one shown in FIG. 3, with the rear wall of the drawer secured.
Figure 5:
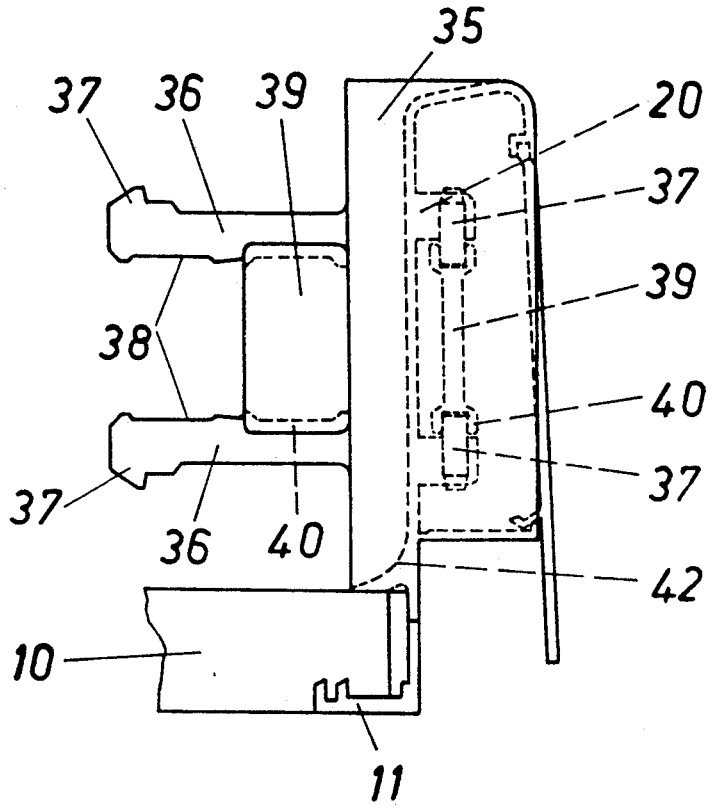
FIG. 5: One rear corner of the drawer, with the rear wall removed, in plan view.
Figure 6:
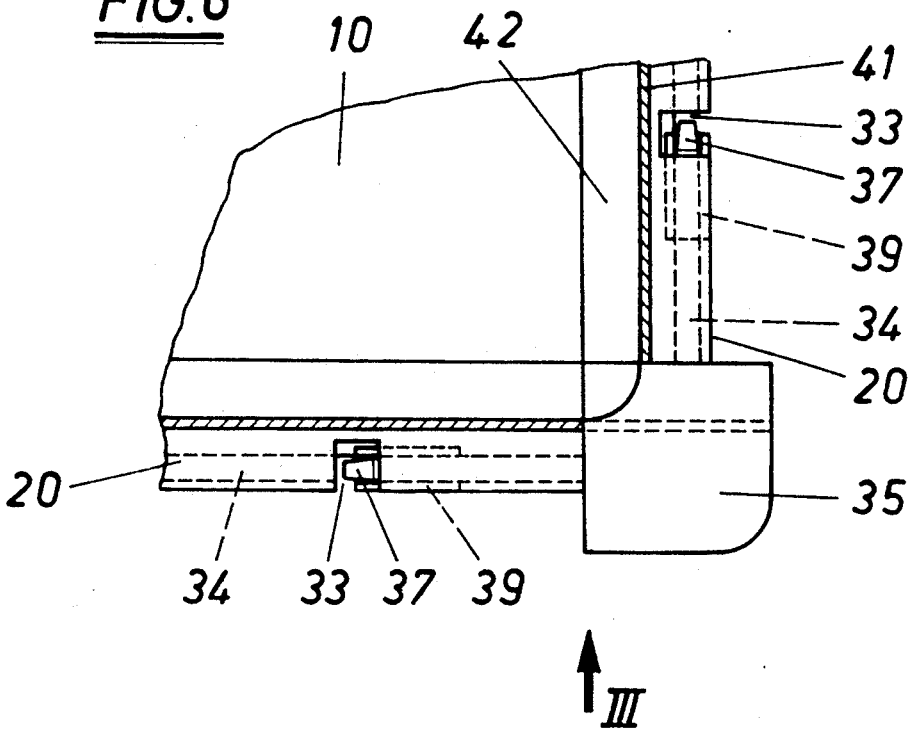
FIG. 6: A plan view of the embodiment shown in FIGS. 3 to 5.
Figure 7:
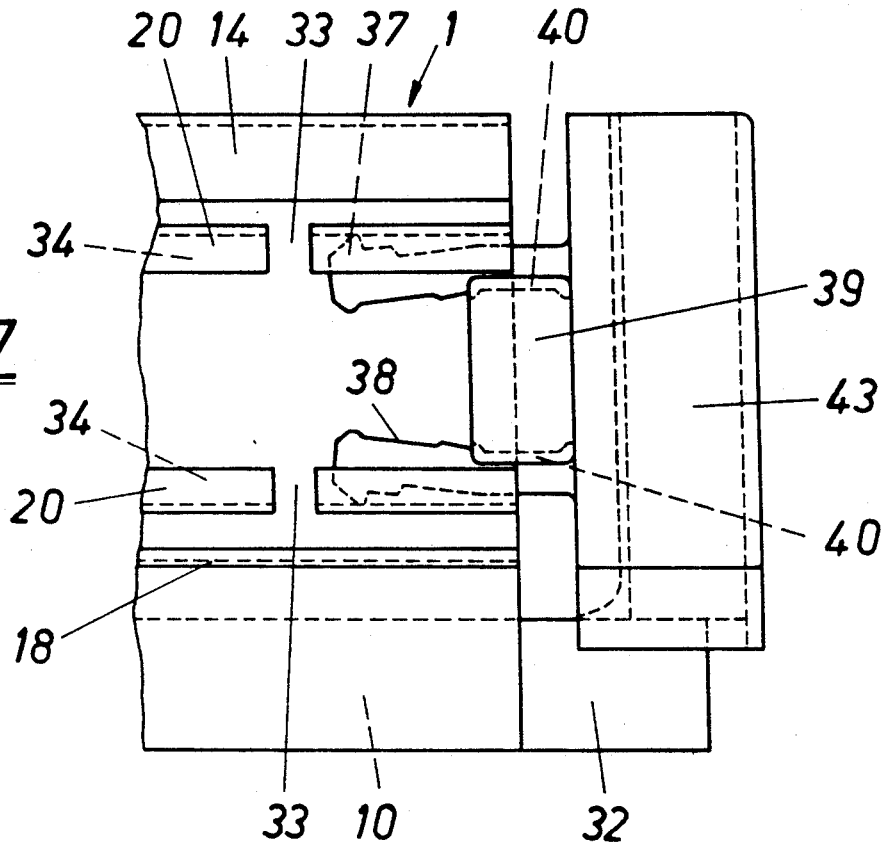
FIG. 7: A view corresponding to FIG. 3, with a modified version of the rear wall of the drawer.
Figure 8:
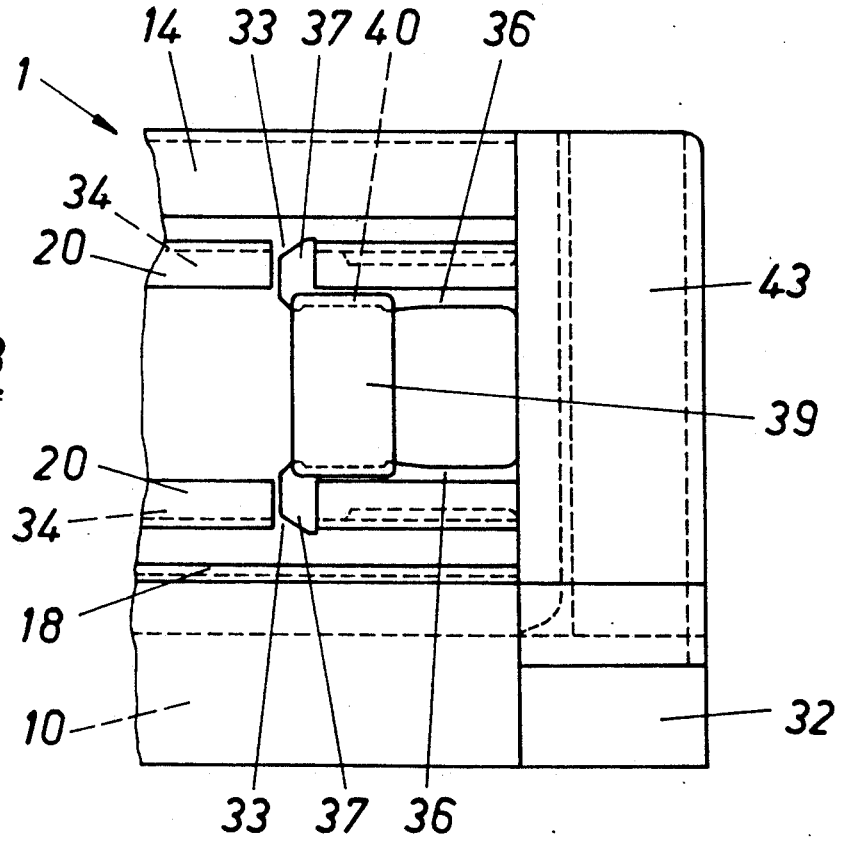
FIG. 8: A view of FIG. 7 corresponding to FIG. 4.
Figure 9:
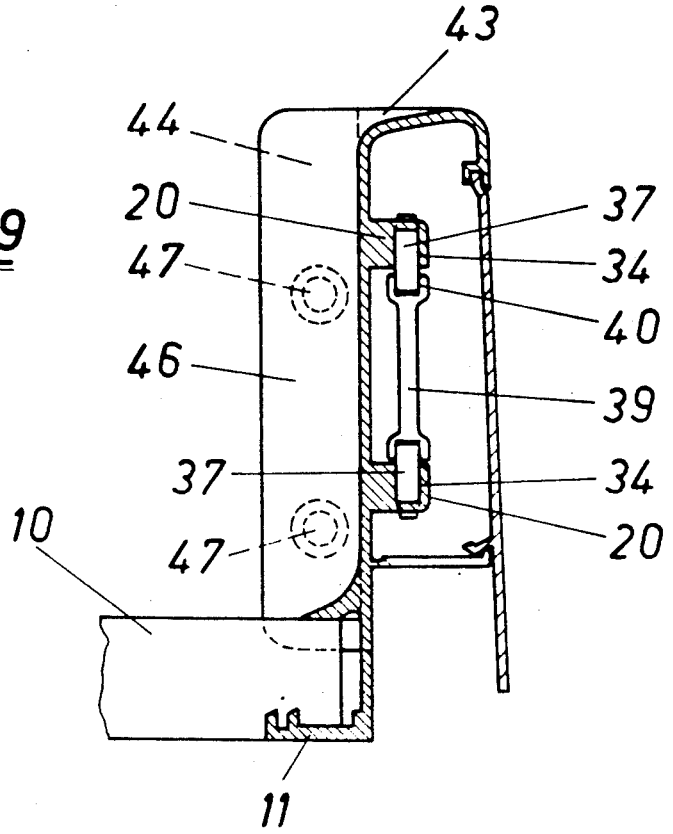
FIG. 9: A rear corner of the drawer in cross section, on the line IX—IX in FIG. 10.
Figure 10:
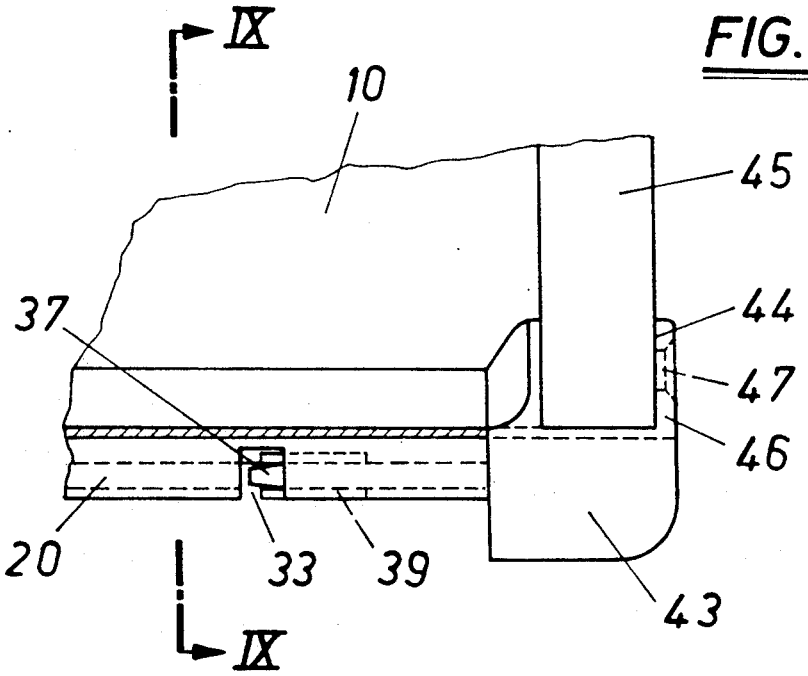
FIG. 10: A view of the drawer as in FIGS. 7 to 9, corresponding to FIG. 6.

FIGS. 1 and 2 shows a profile 1 of the side frame that comprises two profile elements 1, 2, a drawer rail 3 of a pull set that consists of a drawer rail 3, case rails 4, and front and rear rollers 5, a supporting and adjusting set 7 for the front panel 6, and a back wall 8 that in the area of the rear roller that is mounted on the drawer rail 3 incorporate a recess 9, the configuration and attachment possibilities of which are described in greater detail in FIGS. 3 to 10. FIG. 2 also shows the bottom panel 10.

The profile element 1 is produced as an aluminum extrusion and at its lower end area incorporates a profiled side groove 11 in which the bottom panel 10 fits. In the embodiment shown, this bottom panel 10 is secured by having its lower edge milled out and the profiled edge of the groove side wall pressed into position. It could also be joined to the profile 1 by screws, dowels, or by any other known method. The drawer rail of the pull set 3 to 5 has curved claws 12 that fit into the groove 11 and are joined securely to the bottom of the groove by this hooking effect, when a flange of the drawer rail 3 provides additional support for the lower wall of the groove 11 and thus for the bottom panel 10. The case rail 4 is secured by supporting angles 13 that are spaced along the case of the piece of furniture.

The upper edge 14 of the profile element is bent outwards and curved down over a deeper groove section 15 of the profile 1, this drawn-in edge then forming a retaining profile, formed as a groove that is open at the bottom, for the upper edge of the profile element 2 (cover profile). Above the area of attachment for the pull set 3 to 5 there is a cross piece 17 that defines the lower limit of the groove chamber; the unattached edge of this cross piece is bent upwards and interacts with a snap profile 19 that is formed from the cover profile 2. In place of the cover profile 2 it would be possible to provide a snap-on cover that either slides into place or is secured by edge-attachment elements. If it is neither desirable nor necessary to cover the attachment of the pull set 3 to 5, the profile 2 need not extend beyond the groove opening 15. Different surface configurations can be imparted to the profile 2 by means of profiling, anodizing, coating, painting, the application of adhesive foils, lettering, and the like.

In its area that lies in the groove opening 15, the profile element is provided with moulded profile projections 20 that have an angular profile in cross section. These serve as insertion guides for the retaining elements of a push or snap connection and, as shown in FIGS. 1 and 2, accommodate a supporting plate 22 for the adjusting set 7. These profile projections 20 define the insertion grooves 34 that can be seen in FIGS. 3, 4, 7, 8, and 9, when the supporting plate 22 is thickened by a doubler 23. In addition, there are supporting cross pieces 21 for the supporting plate 22. Once the supporting plate has been slid into position, dimples 24 are made from the outside of the profile projections 20, which means that the supporting plate is connected immovably and in the correct position relative to the profile element 1. It would also be possible to effect this attachment by other means such as peening, rivetting or bolting in the case of appropriately modified profile projections 20, 21, or the supporting plate could be attached by means of supporting arms, as described in connection with the corner connectors shown in FIGS. 3 to 10.

The adjusting set comprises the supporting plate 22 described heretofore, an intermediate plate 25, and an adjuster angle 26, the intermediate plate 25 being adjustable relative to the supporting plate 22 with respect to height and the adjuster angle 26 being adjustable relative to the intermediate plate 25 with respect to longitudinal direction, inclination, and transverse distance from the supporting plate 22. The adjusting and clamping screws that are needed to do this are numbered 27 to 30.

An appropriate configuration for the adjusting set is known, fundamentally, from EP-A-0 323 822.

At the front end of the adjusting angle 26 there is a second, flange-like angle arm 31 that is connected rigidly, e.g., by dowels, to the front panel 6 of the drawer; this can be positioned precisely during installation with the help of the two adjuster sets that are provided on the frame 1 so that there are gaps of equal width, which line up exactly, between the front panels of adjacent drawers in the furniture. Like the front panel, the back wall 8 can also be of different materials, e.g., wood, metal, or plastic, and connected to the frames 1, 2 and optionally to the bottom 10, with preferred types of attachment being shown in FIGS. 3 to 10.

In FIGS. 3 to 6, the bottom panel has an extension 32 that reaches beyond the end of the frame 1, 2. Cuts 33 are made in the profile projections 20 at a distance from the rear ends, and these serve as detents in a manner that will be described below. A corner connector 35 is used to connect the back wall, this connector being a moulded plastic part that incorporates moulded-on supporting arms 36 that in turn incorporate hook ends 37 and incorporate detent depressions 38 on the sides that face each other. The hook ends 37 of the supporting arms 36 are inserted from the rear into the grooves 34, when they are pushed elastically towards each other. The supporting arms have stop surfaces for the bottom of the groove in the area that is adjacent to the hook ends 37. As soon as a corner connector 35 that has an outline profile that is matched to the profile shape of the profile 1, 2 is at the end of the profile 1, the hooks 37 snap into the detent recesses 33 so that the stop surfaces are on the bottom of the groove. In order to secure the snap connection, a spreader 39 that up to then has been adjacent to the corner connector 35 and which is guided by guide grooves 40 on the sides of the arms 36 that face each other, is slid into the position shown in FIG. 4, until it snaps into the detent depressions 38 and thereby secures the hooks in the detent position. When this happens, when they are crossing over an elevated section that is ahead of the detent depression they are sprung apart and then spring back. The connection can only be released by spreading the arms 36 apart, pushing back the spreader 39, and releasing the hook ends 37 from the detent recesses 33.

In FIGS. 3 to 6, the back wall is a profile that matches the upper area of the profile 1. This profile has a foot section 42 that forms the transition to the bottom panel 10 or 32, respectively, and serves as a hold-down for the drawer bottom 10. The corner connector 35 is also provided with appropriate supporting arms 36 to secure the back wall 41; these fit in the detent recesses 33 and are secured by spreaders 39.

A corner connector is used in the embodiment shown in FIGS. 7 to 10; the configuration of its side that faces the profile 1 corresponds to the corner connector used in FIGS. 3 to 6, but on the other side it has an insertion groove 44 for a back wall 45 that is formed from a panel. A side flange 46 of this insertion groove 46 incorporates screw holes 47 to accommodate the mounting screws. Here, too, the back wall acts as a hold-down for the rear end 32 of the drawer bottom. Both in the version shown in FIGS. 3 to 6 and in that shown in FIGS. 7 to 10, the corner connector 35 or 43, respectively, that is preferably of plastic, fills the re-entrant corner between the side frames and the back wall.

It would also be possible to secure a front wall of the drawer in the manner described in connection with the back wall, although this would not then be adjustable. The insertion connection as was described in connection with the supporting plate for the attachment set, or the supporting arms of the corner connector in interaction with the insertion guide formed from the profile elements 20 could also be used in other long, essentially flat or rail-like structural elements if these were fitted with appropriate insertion guides so that, for example, furniture frames could be joined together in a corresponding manner.

I claim:

1. A furniture element for forming a corner of a drawer comprising:

at least two long, flat structural elements having sides and ends which join to form a corner, and connector means having a supporting element for providing a connection with at least one of said structural elements, said structural elements including a profile element with an insertion guide for receiving said supporting element, said profile element including profile projections which protrude from one side of said structural elements and extend the length of said structural elements, said profile projections being spaced from the longitudinal edge of said structural element and from each other, said profile projections forming grooves which face each other along the length of said structural elements, and said profile projections having cutouts in the bottom of the grooves configured and dimensioned for receiving and detachably retaining said supporting element.

2. A furniture element as defined in claim 1, characterized in that the profile projections are of an angle profile.

3. A furniture element as defined in claim 1, wherein the connector means is configured as a panel, the long edges of which can be slid into the grooves of the profile projections.

4. A furniture element as defined in claim 1, wherein said connector means additionally includes detent catches and wherein said profile elements include detent recesses for receiving said detent catches.

5. A furniture element as defined in claim 4, wherein said connector means additionally includes two supporting arms, having unattached ends for insertion into said insertion guide, which includes grooves, the unattached ends of said supporting arms having notches for engaging the grooves.

6. A furniture element as defined in claim 5, wherein the notches are in the form of detent recesses in the area of the bottom of the groove of the profile projections.

7. A furniture element as defined in claim 5, wherein a spreader bridges the space between said arms and is slidable longitudinally from a rest position that permits the introduction of the supporting arms into the insertion guides into the spread position that locks the notches in the detent position.

8. A furniture element as defined in claim 7, wherein the spreader is guided on both sides with guide grooves on the sides of the supporting arms that face each other and when the supporting arms themselves are in the locked position is secured by being engaged in detent depressions in these sides of the supporting arms.

9. A furniture element as defined in claim 1, which is formed as a drawer with the frames that incorporate the long structural elements, which are provided with supports for the drawer bottom and drawer rails that form part of a pull set for the drawer, each of said rails enclosing a space that extends to the length of the frame and which accommodates a supporting and adjusting set for a front panel of the drawer that forms a connecting element, the adjusting elements of this supporting and adjusting set being accessible from outside the frame, characterized in that the frame consists of two profile elements that are releasably connected to each other, of which one is fitted with the draw rail of the pull set and incorporates a groove profile that is open to the outside, and the second is configured as a cover that can be slid or set in position and closes off the groove opening to form a hollow profile; and in that the profile element that incorporates the drawer rail is provided with the supports for the drawer bottom and within the groove opening with the insertion guides, formed by profile projections and cross pieces, for a supporting element for the adjusting set that is configured as a carrier plate.

10. A furniture element as defined in claim 9, wherein the carrier plate of the adjusting set is secured by permanent deformation of the insertion guides that are formed from the profile element.

11. A furniture element as defined in claim 10, wherein the two profile elements are of a material of lower strength, in particular aluminum, and the drawer rail of the pull set is of material of greater strength, in particular steel, and the drawer rail is secured by claws that are pressed into position through openings in the associated profile element.

12. A furniture element as defined in claim 11, wherein the drawer rail of the pull set that is attached at about the level of the bottom in the area of the lower edge of the associated profile element has a moulded-on flange that reinforces the profile element in the area of contact of the support for the drawer bottom.

13. A furniture element as defined in claim 9, wherein the drawer bottom extends below the rear wall so that when in the secured position this forms a hold-down for the drawer bottom.

14. A furniture element as defined in claim 9, wherein the connector elements incorporate a supporting body that is matched to the cross section shape of the frame, or front or back wall, that extends as far as it, and fills the reentrant corner that is formed between these, and from which the supporting elements extend that are inserted into the insertion guides.

15. A furniture element forming the side walls of a drawer comprising:

at least two longitudinally extending wall members having sides and two profile projections formed as longitudinally extending L-shaped rails located on one side of said wall members and extending across the entire length of said wall members, each of said L-shaped rails being spaced from the longitudinal edge of said wall members and from the other of said L-shaped rail, each of said L-shaped rails attached to said side of said wall members to cooperatively define a groove which opens towards the other of said L-shaped rails, said L-shaped rails having an aperture; and a connecting element having a flexible plug connector for forming a corner between adjacent wall members, said plug connector being slidably insertable into the groove, and including a detent for engagement with the aperture of said rails.

* * * * *